US006062770A

United States Patent [19]

Beck

[11] Patent Number: 6,062,770

[45] **Date of Patent: *May 16, 2000**

[54] METHOD FOR UNDERPINNING BUILDINGS

[76] Inventor: Roland Beck, Hirschweg 2, Mainburg, Germany, D-84048

[ * ] Notice: This patent issued on a continued prosecution application filed under 37 CFR 1.53(d), and is subject to the twenty year patent term provisions of 35 U.S.C. 154(a)(2).

[21] Appl. No.: 08/849,696

[22] PCT Filed: Aug. 16, 1996

[86] PCT No.: PCT/DE96/01526

§ 371 Date: Jun. 11, 1997

§ 102(e) Date: Jun. 11, 1997

[87] PCT Pub. No.: WO97/07295

PCT Pub. Date: Feb. 27, 1997

[30] Foreign Application Priority Data

| | | | |
|---|---|---|---|
| Aug. 17, 1995 | [DE] | Germany | 195 30 304 |
| Dec. 20, 1995 | [DE] | Germany | 195 47 763 |

[51] Int. Cl.[7] ..... E02D 5/00

[52] U.S. Cl. ..... 405/230; 405/229; 405/239; 405/266; 405/184

[58] Field of Search ..... 405/133, 150.1, 405/150.2, 147, 230, 239, 229, 262, 184, 174, 249, 141, 144, 266, 267, 268, 269

[56] References Cited

U.S. PATENT DOCUMENTS

| | | | |
|---|---|---|---|
| 1,085,600 | 2/1914 | Goldsborough | 405/230 |
| 1,093,262 | 4/1914 | Goldsborough | 405/230 |
| 2,561,676 | 7/1951 | Ruff | 405/131 |
| 3,091,938 | 6/1963 | Schnabel, Jr. | 405/230 |
| 3,224,203 | 12/1965 | Brannfors et al. | 405/150.2 |
| 3,429,126 | 2/1969 | Wey | 405/267 |
| 3,854,294 | 12/1974 | Frank | 405/230 |
| 4,119,764 | 10/1978 | Mizuma et al. | 52/737 |
| 4,280,771 | 7/1981 | Schwing et al. | 405/150.1 |
| 4,832,533 | 5/1989 | Ringesten | 405/233 |
| 4,834,582 | 5/1989 | Bullivant | 405/230 |
| 4,906,140 | 3/1990 | Clark | 405/230 |
| 5,085,539 | 2/1992 | Massarsch | 405/229 |
| 5,314,267 | 5/1994 | Osadchuk | 405/184 |
| 5,433,557 | 7/1995 | Houghton | 405/229 X |
| 5,678,957 | 10/1997 | Lipsker | 405/262 X |
| 5,749,678 | 5/1998 | Dose et al. | 405/184 |

FOREIGN PATENT DOCUMENTS

| | | | |
|---|---|---|---|
| 2686356 | 7/1993 | France | 405/230 |
| 2 217 459 | 10/1973 | Germany . | |
| 227 995 A1 | 10/1985 | Germany . | |
| 2067623 | 7/1981 | United Kingdom | 405/230 |
| 2205121 | 11/1988 | United Kingdom | 405/230 |
| 2254631 | 10/1992 | United Kingdom | 405/230 |

OTHER PUBLICATIONS

"Hausunterfangung Im Zuge Der Frankfurter U–Bahn," by peter Höhmann and Robert Süss, PZ Journal für Freunde und Mitarbeiter des Hauses Polensky & Zöllner, Sep. 13, 1984.

*Primary Examiner*—Eileen Dunn Lillis
*Assistant Examiner*—Jong-Suk Lee
*Attorney, Agent, or Firm*—O'Melveny & Myers LLP

[57] ABSTRACT

A method for underpinning a building comprises arranging at least one elongated supporting element below and substantially parallel to the foundation of the building. A whole side wall of the building may thus be underpinned in a single operation without unnecessarily weakening the existing underground. By coupling a plurality of elongated supporting elements, a kind of large-surface foundation that securely supports the building can be created. The architectonic substance of very old buildings may thus be preserved in a non-aggressive manner. In addition, the underpinning method can be carried out very quickly and at a relatively low cost.

30 Claims, 7 Drawing Sheets

FIG. 5
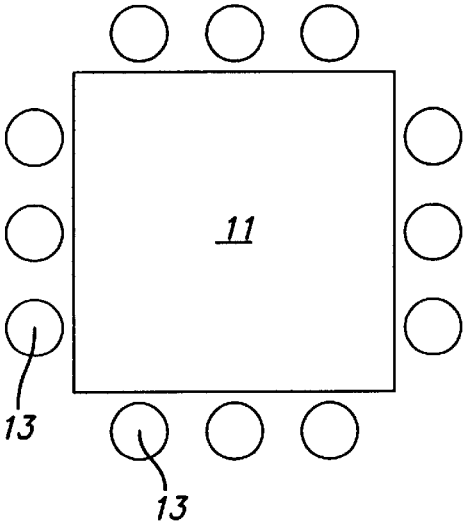
FIG. 7
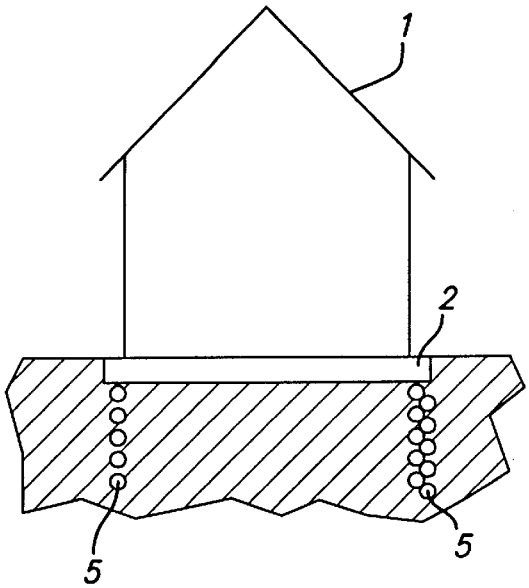
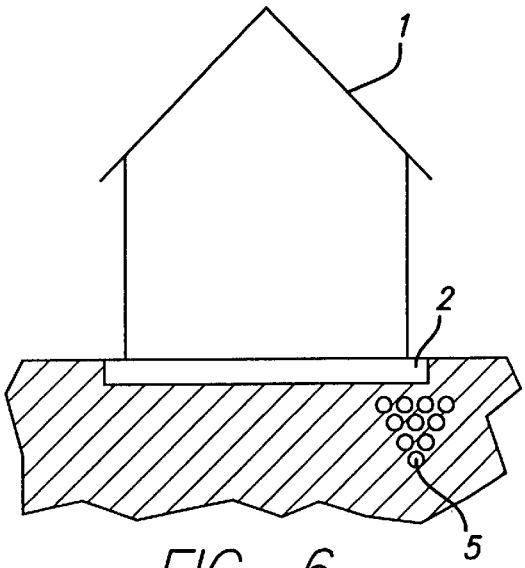
FIG. 6
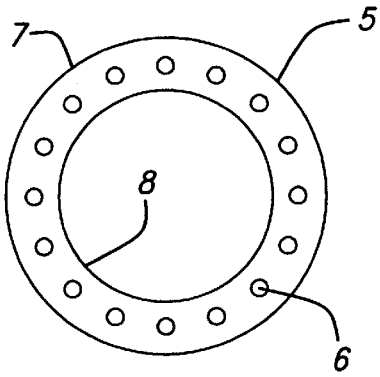
FIG. 8
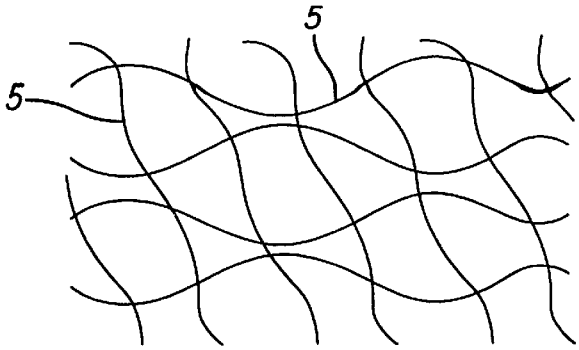
FIG. 9

FIG. 13
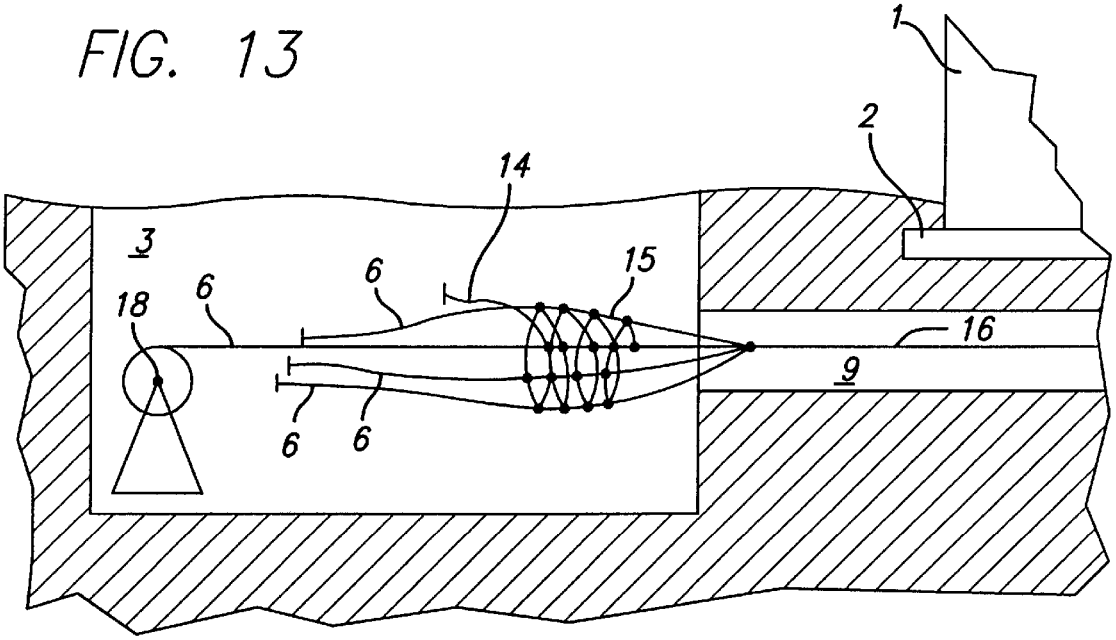
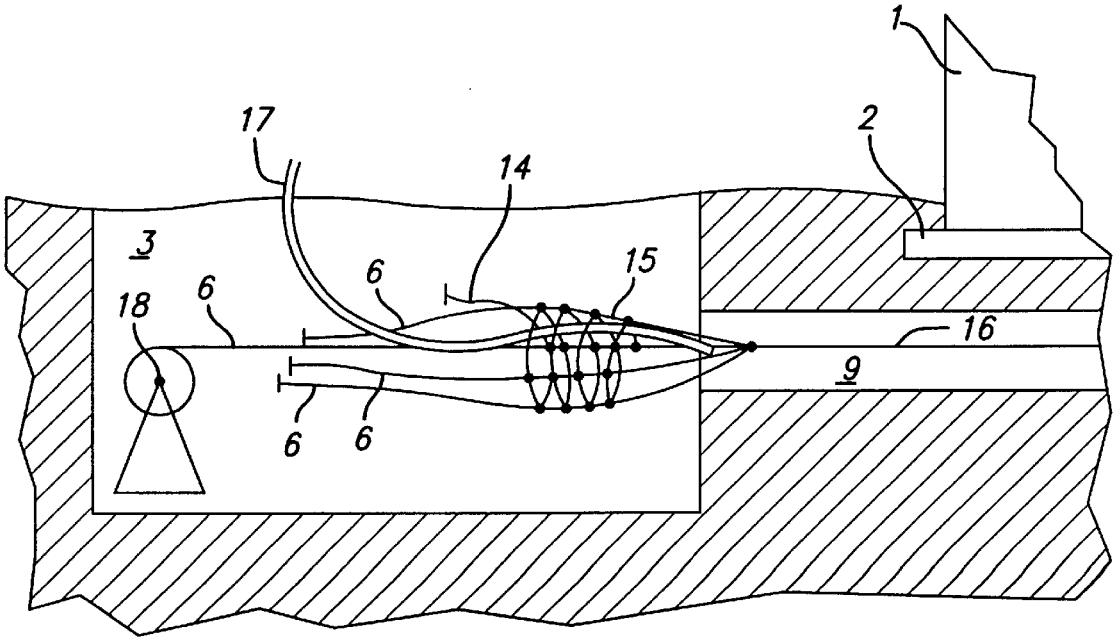
FIG. 14

METHOD FOR UNDERPINNING BUILDINGS

This application is filed under 35 USC § 317 of PCT/DE96/01526 which was filed on Aug. 16, 1996.

BACKGROUND OF THE INVENTION

The invention concerns a method for underpinning buildings in accordance with claim 1 and furthermore a method of forming reinforced-concrete supporting elements in accordance with the preamble of claim 17.

It has long been known to consolidate foundations on unstable subsoil by excavating from under portions of the foundations and supporting these through an underlying concrete or brick structure. As part of the foundation is deprived of its support in the subsoil in the process, particularly in the case where the structure is in a state of decay, there is a risk of cracks forming in the brickwork and of the building collapsing in the worst case. These works must consequently be carried out with utmost care and are highly time-consuming.

SUMMARY OF THE INVENTION

It is therefore an object of the invention to propose a method whereby underpinning of buildings may be performed speedily and safely with simple means.

This object is attained by arranging at least one elongated supporting element in a direction substantially parallel to the foundation underneath the building to be underpinned.

This has the essential advantage that an entire section of a building's foundation may be underpinned in a single operation. Producing the elongated supporting element thus does not affect the subsoil on which the foundation rests to such a degree as to result in subsidences. At the same time, a stabilizing element for the entire side of the building is present underneath the foundation after completion of the elongated supporting element.

As a result, the time required for underpinning is reduced substantially as the entire section of the foundation is underpinned in one operation, other than in the previous technique wherein portions of the foundation were underpinned piece by piece.

It is another essential advantage that the hazard of accidents to working personnel can be reduced substantially as they will not be present immediately underneath the wall to be underpinned but in a lateral distance from the building.

It is another advantage that the building to be underpinned is less strained by this method, and the risk of the brickwork developing cracks or even collapsing is diminished substantially.

It is another advantage of this method that means common in constructional engineering and in civil engineering may be employed for its implementation. The technology necessary for carrying it out is thus available and comparatively inexpensive.

Further advantages can be obtained if a plurality of elongated supporting elements are arranged underneath the foundation and at least partly coupled among each other. Hereby the foundation is underpinned stepwise and may thus increasingly be stabilised. For producing a single supporting element, its dimensions are selected such that the subsoil below the foundation is affected only to an insignificant extent. Owing to the interaction of several supporting elements the foundation is then increasingly supported and eventually rests securely. In this manner a kind of large-surface foundation is created which has the effect of a "raft" carrying the foundation on the unstable subsoil.

Particularly by arranging supporting elements in a grid-like manner it is possible to obtain efficient underpinning of the entire building in the case of larger structures such as churches etc. Such buildings generally have a structure wherein the load of the building rests on a grid of supporting columns. These columns are partly located in the side walls and partly in the inner space o f the building. Due to the grid-like arrangement of the supporting elements, it is possible to proceed by specifically supporting respective load-bearing elements. Non-aggressive underpinning of all the load-receiving points of the building is therefore possible.

It is furthermore also possible to underpin single columns in the inner area of a building if the foundation settles in one area of the building only.

It is a further advantage if a system of mutually coupled supporting elements is established under the building to be underpinned. Herefor supporting elements designed as tensile and compressional members may specifically be arranged and coupled to each other such as to establish a connection with a stable subsoil and receive the load of the building.

A stable design of the elongated supporting element may be achieved by creating the individual supporting elements through introducing a bore underneath the foundation and producing in this bore a hollow or closed rod having a circular cross-section and possibly including tensile and compressional cables. The supporting element is thereby enabled to absorb tensile as well as compressional forces. Particularly where the subsoil underneath the building does not have a uniform consistency, various load conditions subject to change in the course of time must be provided for. This makes for a strong supporting element, the load bearing capacity of which can be increased by interaction with further supporting elements to thereby enable absorption of the required load. The annular configuration of the supporting element furthermore enables introduction of reinforcing elements and concrete in the free core area, whereby the arrangement is further consolidated. In addition it is possible, e.g. at points of intersection under supporting elements, to inject concrete at high pressure by means of openings in the concrete ring, whereby the individual supporting elements are interconnected and the space under the supporting element is filled up with concrete to displace the loose subsoil.

As an alternative it is also advantageous to form the individual supporting elements by introducing a bore underneath the foundation and filling this bore with steel wire fabric and injected concrete. This substantially reduces the expense in comparison with formation of the concrete ring including tensile and compressional cables. Depending on the application at hand, the simple method or the more expensive one may be employed.

If the bore is created by means of an anchor boring device or a tunnelling device or excavator, this has the advantage that means known e.g. from sewer construction may be utilised. By using these means which create a stable borehole in the subsoil—which particularly in the case of the tunnelling device is furthermore compacted outwardly—the desired bore may be created in a simple manner.

If the supporting elements are formed by introducing a bore underneath the foundation, press-inserting pipes and filling the latter with steel wire fabric and injected concrete, then a stable bore can be created particularly in the case of loose subsoil such as e.g. gravel or sand. Under certain circumstances, the bore produced in these subsoils would collapse very quickly even before its consolidation by means of a concrete ring or steel concrete could be accomplished. Thus the danger of further deconsolidation of the subsoil is reduced in this case.

This kind of bore with press-inserted pipes is advantageously established by means of a pipe pressing or shield driving method. In other words, it is once again possible to revert to methods commonly applied in civil engineering.

It is a further essential advantage if bores having a vertical or downward orientation are introduced between the margin of a supporting element and the at least one supporting element. Hereby the subsoil under the supporting element can be further consolidated by being encompassed in a ring of downwardly oriented bores. The unstable subsoil thus rests on the supporting elements placed in parallel with the foundation and on the bores having an upright orientation, or on the steel concrete supports introduced into them, respectively.

The downwardly oriented bores are filled with concrete, preferably steel-reinforced concrete, which is introduced in particular by high-pressure injection. This results in a certain displacement of the unstable subsoil underneath the foundation, and the space is filled up with concrete. Where the subsoil cannot be displaced, it will be compacted in such a degree as to be present in a stable condition.

On the other hand, the area between the at least one supporting element and the supporting element can be excavated and filled with concrete, preferably steel-reinforced concrete, after the downwardly oriented bores have been introduced and a support has been provided in them. This may equally serve to achieve stable underpinning of the load-bearing element.

If several supporting elements are arranged in a stacked configuration, then formation of an upright wall may be achieved by coupling them among each other. In this manner, for example in tunnel construction, it is possible to create a shaft between two points which is constituted of outer walls of individual supporting elements. The soil inside the shaft can subsequently be removed. Cellaring of already existing buildings is also conceivable in this manner.

Forces originating in the soil and in the burden may be balanced by flooding the cavities of the supporting elements. Hereby it is possible to effect or prevent lifting or heaving of the building according to necessity. In the case of varying soil consistency, particularly with a view to the ground water table, the stresses acting on the building can be balanced.

Another aspect of the invention furnishes a method whereby cavities in the ground may be stabilised.

This is achieved by introducing a binding agent into the periphery of the cavity while the cavity is being created.

Hereby it is possible to remedy problems brought about by an instability of the bore, which occur particularly in the case of loose subsoil such as e.g. sand or gravel, or in the presence of high water pressure. In this context it is an essential advantage that this consolidation may be achieved directly in connection with creating the cavity. Thus an apparatus for injecting the binding agent may be arranged directly following the boring apparatus. This makes good use of the fact that the soil is generally present in a compacted form directly behind the end of the tunnelling device and will thus, at least for a short period, be dimensionally stable. Subsequent introduction of a binding agent reliably consolidates the cavity.

For this purpose one-component or multi-component binding agent may be utilised, e.g. concrete, resins, silicates or other suitable mineral substances, or polymers.

This is suited to substantially reduce the expenses for forming stable bores, particularly in the case of the present invention.

In accordance with a further aspect of the invention, a method of forming reinforced-concrete supporting elements is furnished.

Reinforced-concrete supporting elements are conventionally obtained by bending constructional steel elements into so-called reinforcement cages and using wires to connect them with further reinforcing elements such as e.g. constructional steel rods etc. The reinforcement thus produced is then placed inside formwork, i.e. an area to be filled with concrete, and embedded in concrete.

In the above described method for underpinning buildings, elongated supporting elements are arranged substantially in parallel with a foundation. To this end, a bore intended for receiving a reinforcement is formed underneath the area to be underpinned. The bore is subsequently filled up by pouring concrete.

Since such a bore is positioned underneath the foundation of the building to be underpinned, start and target shafts have to be provided in most cases in order to produce the bore. The dimensions of start and target shafts are, however, generally kept small because only a minimum amount of soil should be displaced, and because the available space is in many cases restricted by adjoining buildings or the like. As a result, the length ratio of a prefabricated reinforcement is unfavorable compared with the space available for inserting it into the bore, whereby insertion of the reinforcement into the bore may cause considerable difficulties.

The formation of reinforced-concrete supporting elements can be simplified substantially by introducing single steel cables into the bore following completion of the boring process and combining them with further reinforcing elements during their introduction to thereby form a reinforcement.

This makes it possible to continuously form the reinforcement on the site. For this purpose the individual reinforcing elements can separately be approached to the bore opening to thereby make use of the flexibility of the individual elements. This substantially facilitates work in the workspace inside the shaft which is generally limited. Only immediately prior to insertion into the bore, the components of the reinforcement are combined with the steel cables into a reinforcing cage which substantially has dimensional stability. Insertion of such a reinforcement is therefore simplified substantially in comparison with a conventional, pre-fabricated reinforcement. Construction of reinforced-concrete supporting elements can in this manner be simplified substantially particularly in the presence of unfavorable local circumstances.

It is another advantage if, upon retracting the boring apparatus or the drive means of the boring apparatus into the starting area following completion of the bore, a hauling element, in particular a steel cable, is pulled through the bore and subsequently used to take the reinforcement, which is preferably arranged in the starting area, through the bore. Thus the operation of removing the boring apparatus or the drive means for the boring apparatus, which is inevitable in any case, is combined with the introduction of a hauling element which is later on used for guided introduction of the reinforcement into the bore.

In this case the reinforcement is connected to the hauling element and drawn into the bore by it. Herein it is an essential advantage that introduction of the reinforcement into the bore is guided, and that moreover introduction by means of pulling forces may be accomplished in an essentially easier manner than insertion by pressure. The risk of the reinforcement getting hooked on the bore wall and thus of blocking is distinctly lower.

It is in this case furthermore advantageous if the reinforcement has not been completed yet at its end connected to the hauling element and e.g. constitutes a conical configuration which slides through the bore with comparative ease.

Due to the fact that the steel cable with the reinforcement fastened to it is pulled through the bore by means of a cable winch preferably arranged in the target area, the forces required for introducing the reinforcement can be applied reliably. The progress of introduction can furthermore be controlled in a continuous manner to thereby prevent jolting etc. which may occur when the reinforcement is hooked on the bore wall e.g. upon hauling by hand.

As an alternative it is also possible to haul the reinforcement into the bore in the process of retracting the boring apparatus, or the drive means for the boring apparatus, respectively, into the starting area. This makes it possible to omit the introduction of a hauling element since the retracting motion of the boring apparatus is thus employed for introducing the reinforcement. This further simplifies arrangement of the reinforcement inside the bore.

If the steel cables are connected to a spiral as they are pulled into the bore, then the reinforcing cage can be given the desired configuration. The reinforcement itself will thus remain dimensionally stable and be present in the desired locations. It is thus possible to create well pre-determinable reinforced-concrete supporting elements which in addition have accurately calculated static properties.

If the steel cables are provided in a coil form, then these coils may be arranged in the starting area such that the cables will unroll while being pulled into the bore. Introduction of the steel cables into the bore thus becomes substantially easier. If the length of the steel cables inn the coil is moreover predefined, then the required space in the starting area may be kept small.

The final concrete work may be prepared very well by jointly pulling at least one concrete delivery hose into the bore. If the concrete delivery hose is furthermore continuously retracted during the concrete work, smooth and well controllable filling of the bore with concrete from end to end may be achieved. The formation of cavities particularly in the upper margin between the reinforced-concrete supporting elements and the bore wall can thus essentially be avoided.

BRIEF DESCRIPTION OF THE DRAWINGS

Further aspects of this invention shall be explained below in more detail by way of embodiments and reference to the drawings, wherein:

FIG. 5 is a plan view corresponding to the representation of FIG. 4;

FIG. 6 is a side elevation of a building to be underpinned, with a wedge-shaped arrangement of the supporting elements;

FIG. 7 is a side elevation of a building to be cellared and of supporting elements arranged in a stacked configuration;

FIG. 8 is a section through one embodiment of a supporting element according to the invention;

FIG. 9 is a schematic representation of an interlaced large-surface foundation consisting of supporting elements according to the invention;

FIG. 13 shows a detail of the insertion opening of the bore while the reinforcement is introduced in order to form a reinforced-concrete supporting element;

FIG. 14 is a representation according to FIG. 13, wherein a concrete delivery hose is introduced together with the reinforcement;

DESCRIPTION OF THE PREFERRED EMBODIMENTS

Figure 1:
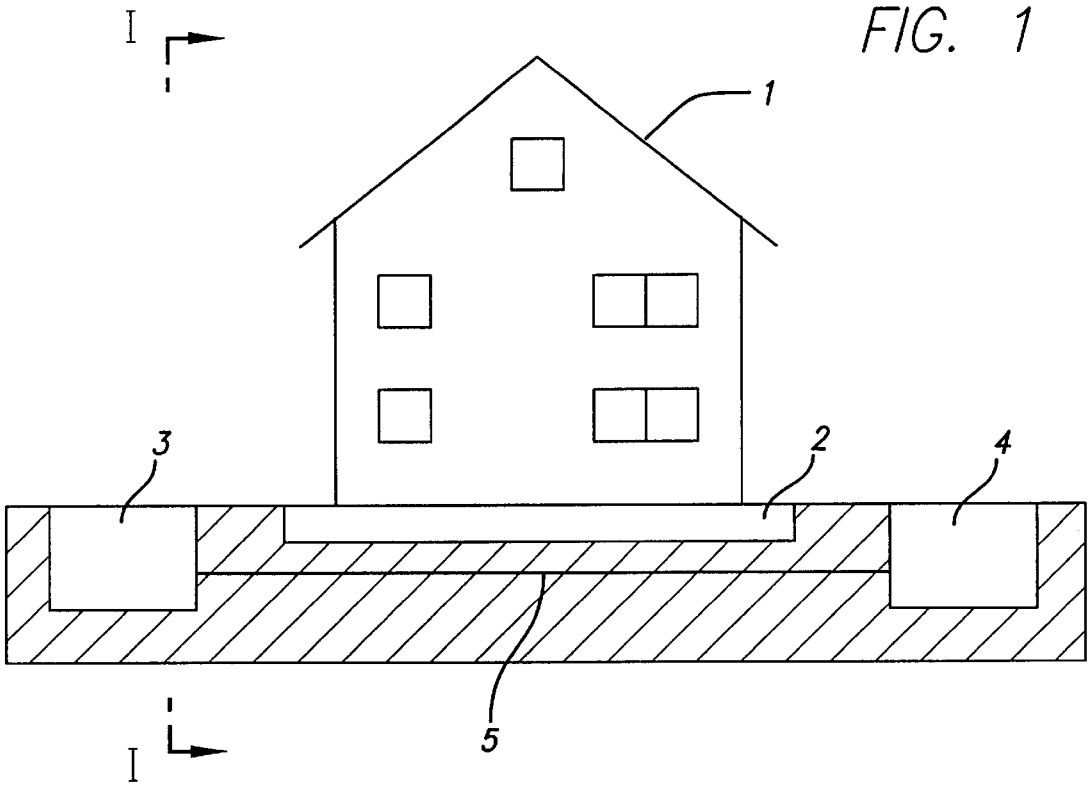
FIG. 1 is a front elevation of a building to be underpinned and of the introduced supporting elements.
Figure 2:
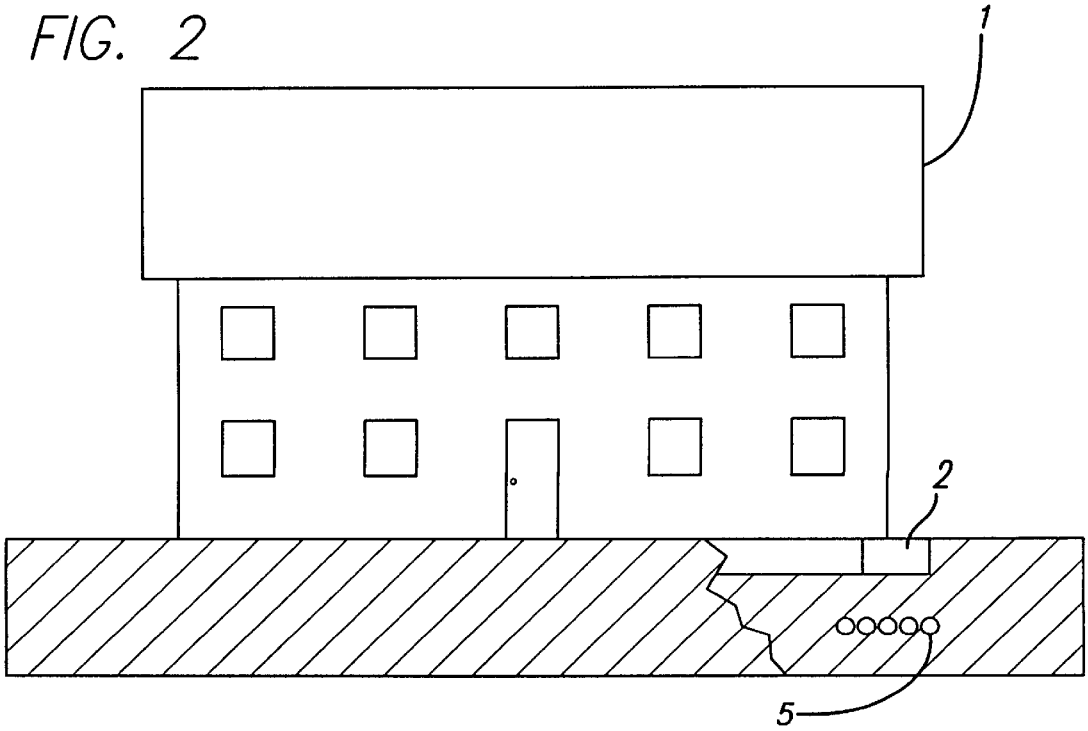
FIG. 2 is a side elevation along line I—I in FIG. 1 of the building to be underpinned and of the introduced supporting elements.

FIGS. 1 and 2 represent a first variation of the method for underpinning buildings. Herein a building 1 is underpinned at a foundation 2 of its front wall. To this end a first shaft 3 and a second shaft 4 are created at a lateral distance from the front wall. By means of a device not represented here and including a tunnelling device, a bore 9 is created between the first shaft 3 and the second shaft 4 at a distance underneath the foundation 2 of the building 1. Inside this bore 9 a supporting element 5 having the form of a concrete ring and including tensile and compressional cables 6 is formed by concreting and by means of suitable formwork (cp. FIG. 8).

In another embodiment the supporting element 5 may also be given the shape of a concrete rod having suitable reinforcement.

The supporting element 5 thus extends at a distance underneath the foundation 2. The diameter of the supporting element 5 is selected such that creating the bore 9 will not unnecessarily destabilize the subsoil under foundation 2. After introduction of the first supporting element 5, additional supporting elements 5 are created in a lateral position. The supporting elements 5 are coupled to each other to form a large-surface foundation acting on foundation 2 like a "raft".

The stabilising effect of this plurality of supporting elements 5 on the foundation 2 of the front wall of building 1 possibly is already sufficient for preserving its structural integrity.

In addition it is moreover possible to create vertical or downwardly oriented bores 13 from the edge of foundation 2 downward as far as the supporting elements 5 and to inject concrete into them. Hereby it is possible to further consolidate the subsoil under the foundation 2.

Whenever it is necessary to underpin one side of a building for the purpose of creating an annex with a basement, i.e. having a foundation in a position essentially below the foundation of the already existing building 1, it is furthermore possible to arrange a sufficient number of horizontal supporting elements 5 in a stacked configuration under the foundation 2. In this way a secure support for the existing building 1 may be achieved and ensured prior to excavation for the annex basement.

Underpinning of the building 1 in the described manner can be obtained for an existing building on one side and—if necessary—even on all sides or under the inner load-bearing walls of the building.

Another example shall serve to describe the creation of a grid of supporting elements 5 underneath a building 1.

Figure 3:
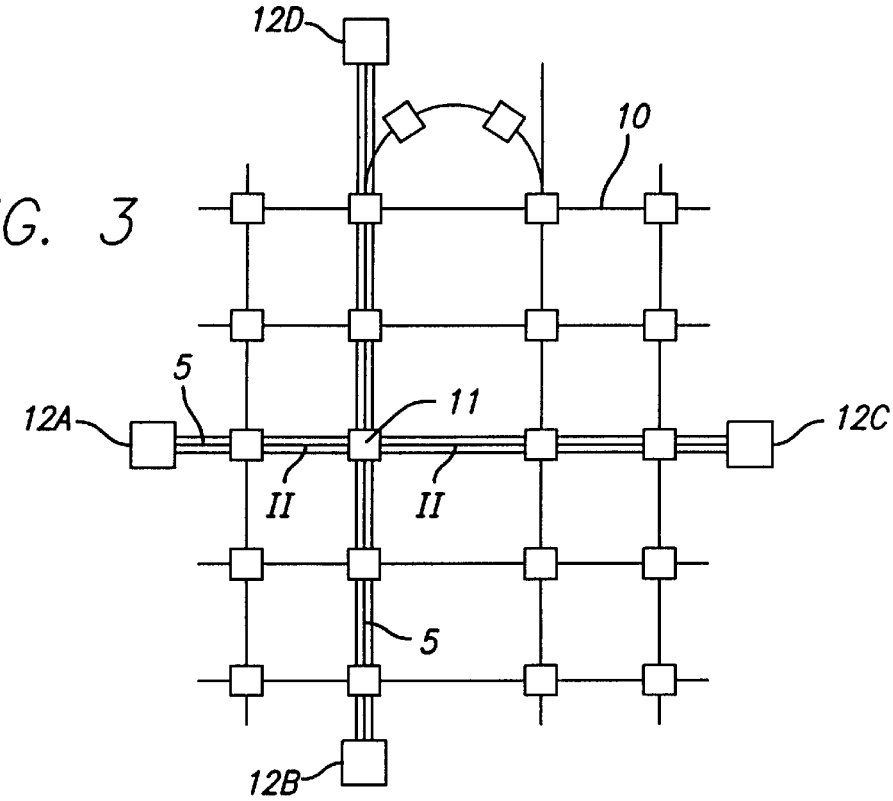
FIG. 3 is a schematic plan view of a three-aisle church structure having supporting elements arranged in a grid shape.

FIG. 3 shows a schematic representation of a three-aisle church building 10 in plan view. The static configuration of the church 10 is essentially supported by vertical supporting structure such as load-bearing elements or columns 11.

In order to underpin the church 10 as a whole, it is sensible to transfer the grid created by the arrangement of columns to the supporting elements 5. This process shall exemplarily be explained by referring to one column 11.

Figure 4:
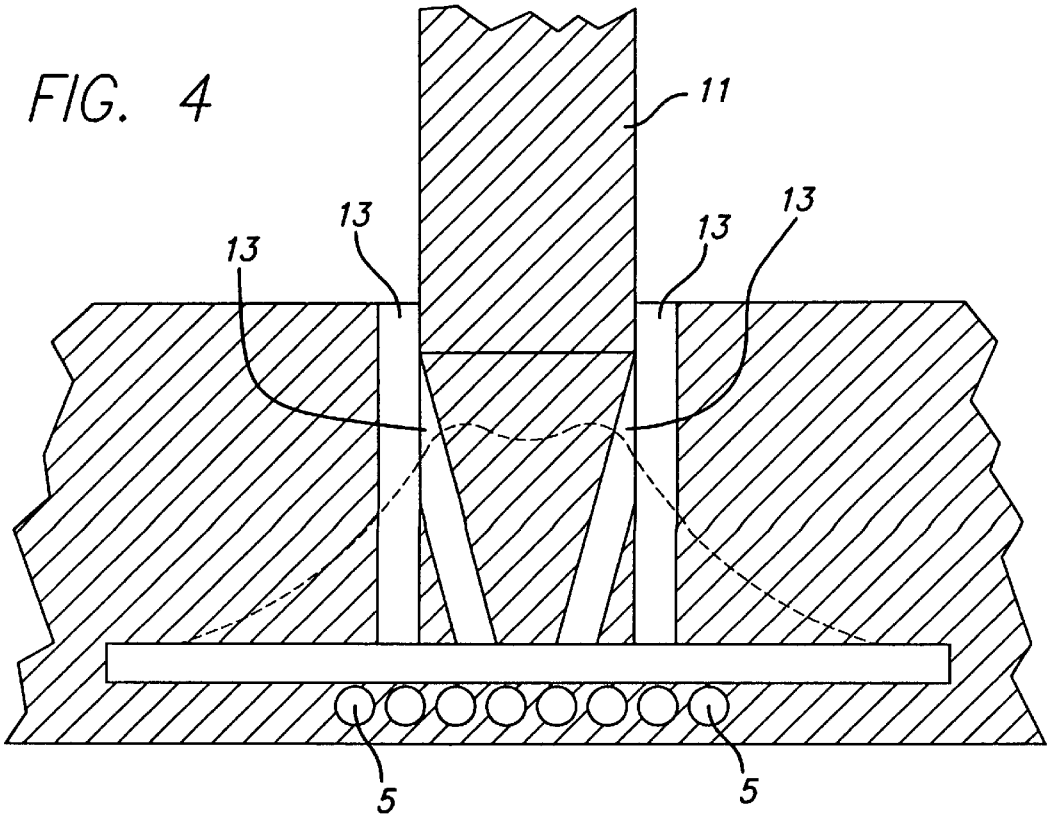
FIG. 4 is a sectional view along the line II—II in FIG. 3 illustrating underpinning of a load-bearing column.

To this end, four shafts 12A–12D are excavated laterally beside the church 10. Starting out from these shafts 12A–12D, a plurality of supporting elements 5 are then created in the transverse direction of the nave and a plurality of supporting elements 5 in the longitudinal direction thereof. The supporting elements 5 are, in accordance with the representation of FIG. 4, provided at a distance underneath the column 11. A row of downwardly oriented bores 13 are then introduced into the church floor in the configuration shown in FIG. 5. The downwardly oriented bores 13 extend downward from the edge of the column 11 as far as the supporting elements 5. The downwardly oriented bores 13 are created partly vertically and partly also in an oblique downward direction. Subsequently, a support is arranged in the downwardly oriented bores 13 such as by filling the bores 13 with concrete by high-pressure injection, with the result that the existing subsoil will partly or even entirely be displaced. This results in the creation of a concrete foundation above the elements 5, which as a rule extends and is present in accordance with the dashed line of FIG. 5.

The downwardly oriented bores 13 may alternatively be filled up from below by injecting concrete into the horizontal bores 9 for the supporting elements 5. This results in a good connection between horizontal and downwardly oriented bores.

The column 11 is thus underpinned and securely supported by a concrete foundation. One proceeds analogously for remaining columns 11 of the church building 10, and according to necessity at the foundations of the outer walls.

In the case of particularly loose subsoil, such as e.g. sand, it is possible, in accordance with the representation of FIG. 6, to construct the plurality of supporting elements 5 in wedge-shaped configuration whose point is directed downward underneath the foundation of a building. By adding further groups of supporting elements in wedge-shaped configuration, secure support for the building is made possible even in this type of case because the groups of supporting elements are wedged against each other. This configuration of the supporting elements 5 may also be transferred to other desired applications for underpinning buildings. Furthermore different configurations of supporting elements 5 are possible according to desire and in correspondence with the requirements of a specific case.

In accordance with the representation of FIG. 7 it is possible, by means of upright supporting elements 5 arranged in a stacked configuration and coupled among each other, to form a wall inside the soil which enables formation of a basement under an existing building. For this purpose the underpinning would e.g. have to be implemented as a wall having a sufficient height on three sides of the building, and on the fourth side an adequate underpinning in the sense of a structural girder. Where the bearing plate of the existing building is capable of absorbing the static forces through the inner bearing walls, or is provided with an underpinning again in the sense of a girder, respectively, the soil may be excavated from under the fourth side of the building. Herein the supporting elements can be arranged in one or several rows such as to result in a type of horizontally arranged pile wall or bore pile wall.

It is understood that a basement may also be formed in another way by means of the supporting elements 5; in this case it is only necessary to take care that the existing building is adequately supported on the subsoil.

FIG. 8 shows the construction of a supporting element 5 in accordance with a first embodiment. It includes a concrete ring provided with tensile and compressional cables 6. These tensile and compressional cables 6 absorb arising tensile forces and pressure loads, respectively. The concrete ring is created by filling up the free space between an external steel pipe 7 and an internal steel pipe 8 and, where necessary, finally provided with a reinforcement and filled by pouring concrete.

Instead of forming this concrete ring including tensile and compressional cables 6 inside the bore 9 underneath the foundation 2 of the building 1, it is equally possible to press in pre-fabricated pipes and in turn fill these with steel wire fabric or suitably arranged tensile and compressional cables and injected concrete.

It is furthermore also possible to fill up the entire bore 9 with a steel wire fabric and injected concrete to thus establish a rod-type supporting element.

Depending on the loads and the consistency of the subsoil, it is possible to revert to either the simpler method or the more expensive one. The bore 9 itself may be created by means of an anchor boring device or tunnelling device, and in a case where pipes are to be pressed in, this can be achieved by means of a pipe pressing or shield driving method.

Pressing in pre-fabricated pipes is recommendable particularly in the case of very loose subsoil such as e.g. sand or gravel in which it is very difficult to create a dimensionally stable bore.

Where loose subsoil or high water pressure in the ground is involved, it is furthermore useful to introduce a binding agent into the peripheral wall of the bore 9 in order to consolidate the bore while the tunnelling device progresses. This injection of binding agent may be effected in star-shaped propagation immediately behind the drive means for the boring apparatus. Suitable binding agents are concrete, resins or the like. The expense for forming the bore 9 is thereby reduced substantially.

This method for consolidation of a bore or cavity in the ground may also be transferred at will to other applications such as e.g. tunnel construction.

In hard, e.g. rocky subsoil, the bore 9 may also be accomplished by sinking.

It is furthermore possible to arrange the supporting elements 5 in several horizontal planes cross-wise underneath each other. Each plane then includes a plurality of adjacent supporting elements 5. Arranging respective equidirectional planes in a staggered formation increases the large-surface foundation effect.

As the technology for steering the boring apparatus is available, it is possible—particularly in the case of underpinning large-surface areas—to arrange a plurality of supporting elements 5 interlacingly in accordance with the representation of FIG. 9. This has the effect that the large-surface foundation thus formed is consolidated in itself by interlocking and is capable of better receiving the loads.

The described configuration of supporting elements 5 arranged in a stacked configuration can moreover be employed in tunnel construction.

The air contained in the cavity of a supporting element according to FIG. 8 may furthermore be utilised, e.g. in the case of wet subsoil, to generate upward hydraulic pressure. The hollow supporting element 5 thus has the tendency of "floating" on the groundwater table, which may even make it possible to lift buildings. In order to achieve this, additional buoyant bodies may also be arranged e.g. in the area of the lateral shafts. This results in a "floating foundation" stabilising the building.

Where e.g. the groundwater table is subject to seasonal variations, or if the upward pressure of the supporting element 5 should turn out to be excessively high, a uniform behavior of the underpinning can be achieved by controlled flooding of the cavity inside supporting element 5. The building will thus not be subjected to variable stresses due to a varying consistency of the subsoil.

Figure 10:
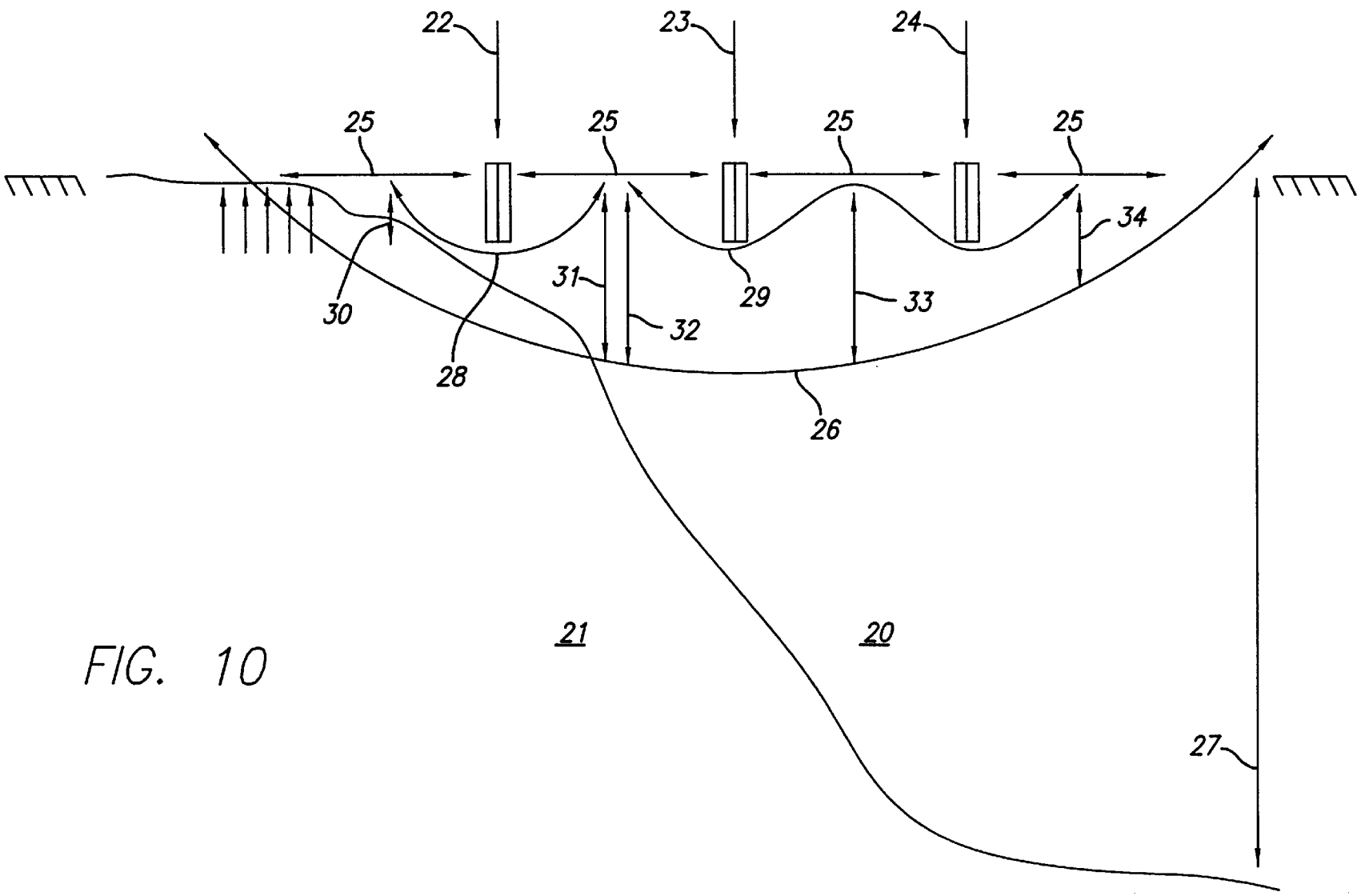
FIG. 10 is a schematic representation of a system of horizontal and vertical supporting elements.

In accordance with the representation of FIG. 10 it is possible to constitute a system of supporting elements 5 in the sense of a "floating bearing" underneath a building to be underpinned to obtain secure support for the building 1.

In accordance with the representation in the figure, a building 1 stands on unstable subsoil 20, e.g. peat, clay, sand or the like, with a stable base layer 21, e.g. rock, provided underneath. The building 1 is in this representation indicated by only three bearing points 22, 23 and 24 representing the foundations of the building.

In order to support the building, initially a first compressional element 25 is arranged horizontally in the area of bearing points 22, 23 and 24. A first tensile element 26 is passed through underneath the bearing points 22, 23 and 24 and anchored on one side in the stable rock layer 21. The other side of the first tensile element 26 is supported on the stable rock layer 21 by means of an upright supporting element having the form of a pillar 27.

The tensile and compressional elements may have the form of a single steel cable or an arrangement of several steel cables, or a reinforcement embedded in concrete.

Further tensile elements 28 and 29 are passed through under the bearing points 22, 23 and 24. Herein a tensile element 28 in accordance with the representation of FIG. 10 can pass underneath a single bearing point 22 or several bearing points 23 and 24 as is indicated for tensile element 29. In the latter case the tensile element can be returned to the surface by steering the boring apparatus between the bearing points.

The additional tensile elements 28 and 29 are supported on the stable base layer 21 or on the first tensile element 26 by means of further compressional elements 30–34. The tensile elements 26, 28 and 29 are tensioned and the bearing points 22, 23 and 24 of the building 1 are supported.

The upright compressional elements 31–34 are placed e.g. directly on the first tensile element 26 or on a plurality of first tensile elements 26 to obtain a stable base.

Figure 11:
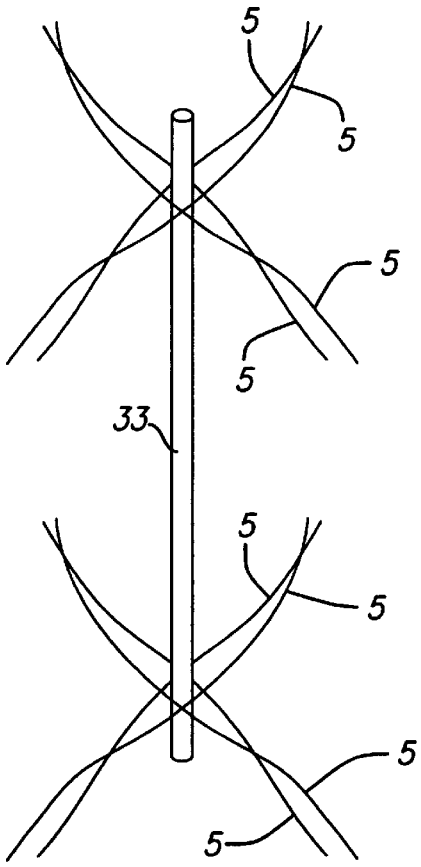
FIG. 11 is a schematic representation of a technique for stabilizing of vertical supporting elements.

FIG. 11 shows how horizontal and upright supporting elements may be coupled to each other to prevent shifting or toppling. E.g., two supporting elements each having a substantially horizontal orientation encompass one upright supporting element in one region thereof from two different directions. This encompassing relation may be repeated in a location spaced apart from the first one to thereby restrict movement of the upright supporting element. The upright supporting element is thus held tightly and wedged between the horizontal supporting elements.

Figure 12:
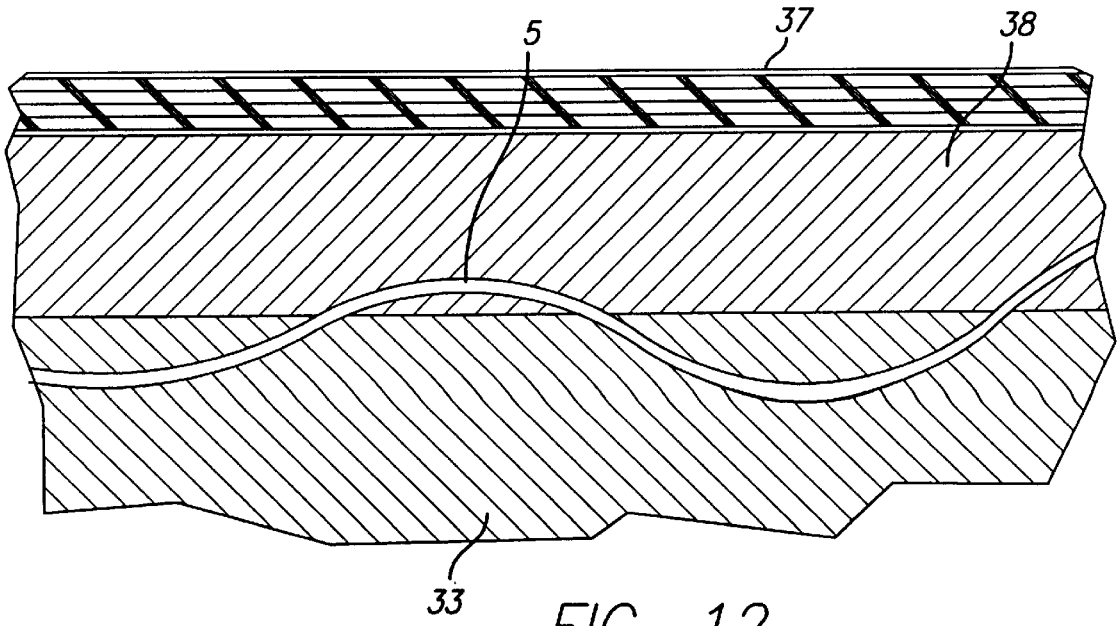
FIG. 12 is a schematic representation of the arrangement of supporting elements in the presence of different subsoil layers.

FIG. 12 shows how the supporting elements 5 of the invention may in the presence of different subsoil layers be employed e.g. under a concrete bearing plate 37 for the purpose of stabilizing the subsoil. Herefor a bore 9 alternatingly passing through the respective subsoil layers is created by means of a steered boring apparatus. Particular in cases of e.g. a gravel layer 38 and a clay layer 39 intermingled by erosion, consolidation may be obtained in this manner.

The technique for creating a reinforced-concrete supporting element shall now be explained in more detail.

Initially a bore 9 is created, e.g. by means of a tunnelling device. The tunnelling device, which is not represented in the figures, is set inside the starting area 3 and moved toward the target area 4 by a drive means such as to form a bore 9 which is stable inasmuch as the soil is displaced. In the target area 4 the head of the tunnelling device is removed and the drive means is eventually retracted into the starting area 3.

Prior to retracting the drive means of the tunnelling device, however, a hauling element, such as steel cable 16 is fastened to the latter, which is thus in turn pulled through the bore 9. The steel cable 16 is paid out by a cable winch positioned in the target area 4, which is not represented in the figures. After the steel cable 16 has arrived in the starting area 3, the drive means for the tunnel excavator is removed from the starting area 3.

In the starting area 3 several cable drums are positioned, of which only one respective cable drum 18 is represented in FIGS. 13 and 14. Steel cables, of which only four cables 6 are represented in FIGS. 13 and 14, are wound on these cable drums. The steel cables 6, just like the further steel cables not represented here, are fastened to the steel cable 16. A spiral 14 of construction steel is arranged around the steel cables 6 and in a known manner combined with the steel cables at predetermined distances, whereby the desired shape of the reinforcement wire cage is achieved. The ends of the steel wires 6 are left free such that they will assume a conical configuration upon mounting to the steel cable 16. The risk of the reinforcement getting hooked while being hauled into the bore 9 is thereby reduced substantially.

The spiral 14 is fastened in the starting range of the steel cables 6. While the reinforcement 15 thus formed is drawn into the bore 9, the spiral 14 is continuously fastened to the steel cables 6 which are again freely provided in front of the opening of bore 9.

In this manner the reinforcement 15 is constituted continuously on the site and hauled stepwise into the bore 9.

After the reinforcement 15 has reached the end of bore 9 in the target area 4, the ends of steel cables 6 are separated from the steel cable 16. These ends of the steel cables 6 are then fashioned to form the desired reinforcement 15 with the spiral 14. As a result, the reinforcement 15 is provided in the desired configuration over the entire length of the bore 9.

In accordance with the representation of FIG. 14, a concrete delivery hose 17 is also pulled into the bore 9 together with the steel cables 6 and is thus provided at the end of bore 9 in the area of the target area 4. The opening of bore 9 in the target area 4 may now, if necessary, be closed by formwork, followed by filling the bore 9 with concrete. To this end, concrete is introduced into the bore 9 through the concrete delivery hose 17. The concrete delivery hose 17 is in the process continuously retracted towards starting area 3 in accordance with the quantity of supplied concrete. Complete filling of the bore 9 is thereby obtained in each area underneath the foundation 2 of the building 1.

If necessary, a supplementary pressure hose may furthermore jointly be introduced into the bore 9 to enable a concrete pressure ensuring complete filling of bore 9.

The concrete work is continued until substantially the entire area has been filled with concrete as far as starting area 3.

Figure 15:
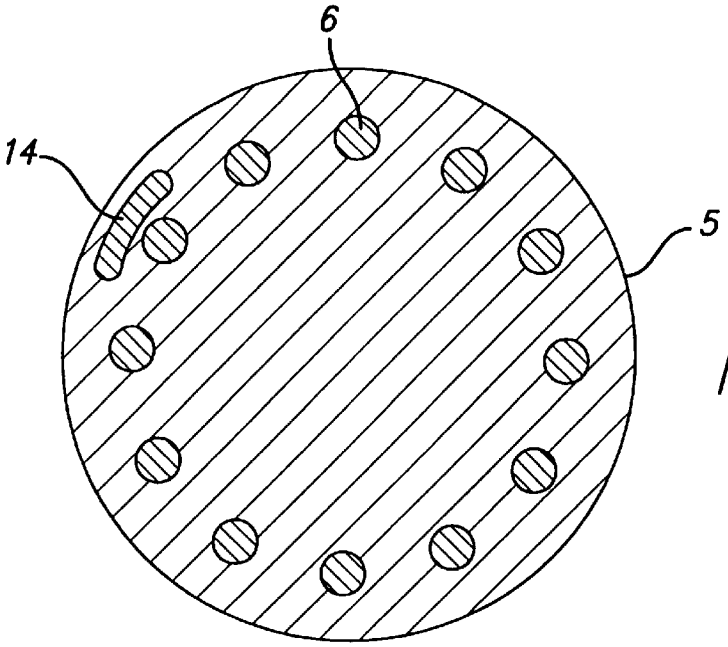
FIG. 15 shows a section through a reinforced-concrete supporting element according to another embodiment of the invention.

After setting there is provided a reinforced-concrete supporting element which is suited as an underpinning for a building 1 having a weakened structural substance. The form of the reinforced-concrete supporting element 5 corresponds to the representation of FIG. 15. This form including arranged steel cables in a ring permits e.g. good absorption of tensile and compressional forces at a right angle to the main direction of the reinforced-concrete supporting element 5.

It is possible to not only support load-bearing walls of buildings in this manner, but for example also to reform insufficiently reinforced bearing plates of industrial structures etc. Such reinforced-concrete supporting elements may furthermore be used to form or subsequently reform basement walls and basement floor plates under existing buildings, for which purposes start and target shafts having only relatively small dimensions are required.

As it is possible to keep the dimensions of start and target shafts small, and as additional excavation works underneath the buildings are furthermore not required, it is not necessary to perform large-volume lowering of a high groundwater table. Merely the start and target shaft must be formed such as to be substantially free of ground water.

Since the reinforcement for the reinforced-concrete supporting elements is formed immediately on the site, prefabricating it is not necessary. In addition, those difficulties are avoided which would result from the low flexibility of such a pre-fabricated reinforcement during its introduction around a corner through a narrow shaft into a horizontal bore in the soil.

Besides the aspects demonstrated above, the invention permits further possible approaches to configuration.

The proposed method can in principle be employed whenever any kind of steel concrete element is to be formed between a starting and target point. This is not limited to bores but is also applicable e.g. to open-top formwork.

In this manner it is also possible to form pipe-shaped reinforced-concrete supporting elements if a different formwork is used for the core.

It is furthermore possible to draw the reinforcement into the bore 9 by using the retracting movement of the drive means for the tunnelling device. In this case, however, the drive means for the tunnelling device is tied up at this site for a certain period of time, i.e. until formation of the reinforcement, and is not available at another location.

The number of steel cables used in forming the reinforcement may be varied as desired, and in certain cases only a single steel cable might even be sufficient. The type of additional reinforcing elements is not limited to the spiral 14 mentioned here, but different elements such as construction steel cages e.g. including construction steel fabrics or the like may also be employed. Instead of the spiral 14, ring elements are also partly utilised in practice, which are more suitable in certain exceptional cases. As a rule, however, they do not provide the high rigidity and load-bearing capacity as in the case of the spiral. The spiral 14 may furthermore be arranged either externally or internally of the steel cables.

It is furthermore possible to introduce not only one concrete delivery hose into the bore, but a desired number of concrete delivery hoses depending on the bore diameter or the available free space.

Application of the method of the invention is furthermore not restricted to horizontal reinforced-concrete elements, but is also possible e.g. for formation of vertical supporting columns in old walls, or consolidation of soil or rock formations.

The steel cables wound on the cable drums may have any desired length or be adapted beforehand to the desired length. In addition it is, of course, possible to omit the cable drums and supply the cables singly from the upper edge of the shaft.

The steel cables 6 are combined to form a reinforcement 15 with the additional reinforcing elements in a manner known per se. This may be achieved by connection through wires, i.e. production of wire mesh, or e.g. by welding the reinforcing elements to each other.

Static analysis of the underpinning of the invention may be carried out by combining the known static analysis methods for the bored pile wall and for the large-surface foundation. The configuration of the supporting elements, e.g. in accordance with FIG. 7, may be treated in the sense of a horizontally arranged bored pile wall, such that calculation is possible with few modifications. The results may be applied to the invention in a meaningful manner in combination with results from a calculation method similar to that for the large-surface foundation. Underpinning of buildings can thus be carried out based on an accurate static analysis.

The invention thus proposes a method for underpinning buildings wherein at least one elongated supporting element 5 is arranged substantially in parallel with the foundation 2 of the building 1 underneath the building 1 to be underpinned. A whole side wall of the building 1 can thus be underpinned without unnecessarily weakening the existing subsoil By mutually coupling a plurality of elongated supporting elements 5, a kind of large-surface foundation can be created that securely supports the building 1. The architectonic substance of very old buildings may thus be preserved in a non-aggressive manner. In addition, the process can be carried out very quickly and at relatively low costs. Moreover the resistance of buildings against earthquakes may in this manner be strengthened in the sense that shock waves are attenuated by means of water filled cavities in the solid subsoil.

It is furthermore shown how a reinforced-concrete supporting element can be obtained in a simple manner. Herefor the construction steel reinforcing elements are joined together immediately on the site and subsequently are gradually inserted into the area to be filled with concrete. This makes use of the greater flexibility of the single reinforcing elements as compared to the rigid arrangement of the pre-fabricated reinforcement, to ensure particularly in restricted locations that the reinforcement can be introduced in a defined manner into the area to be filled with concrete. It is thus possible to form accurately defined reinforced-concrete elements having the desired properties.

Figure 16:
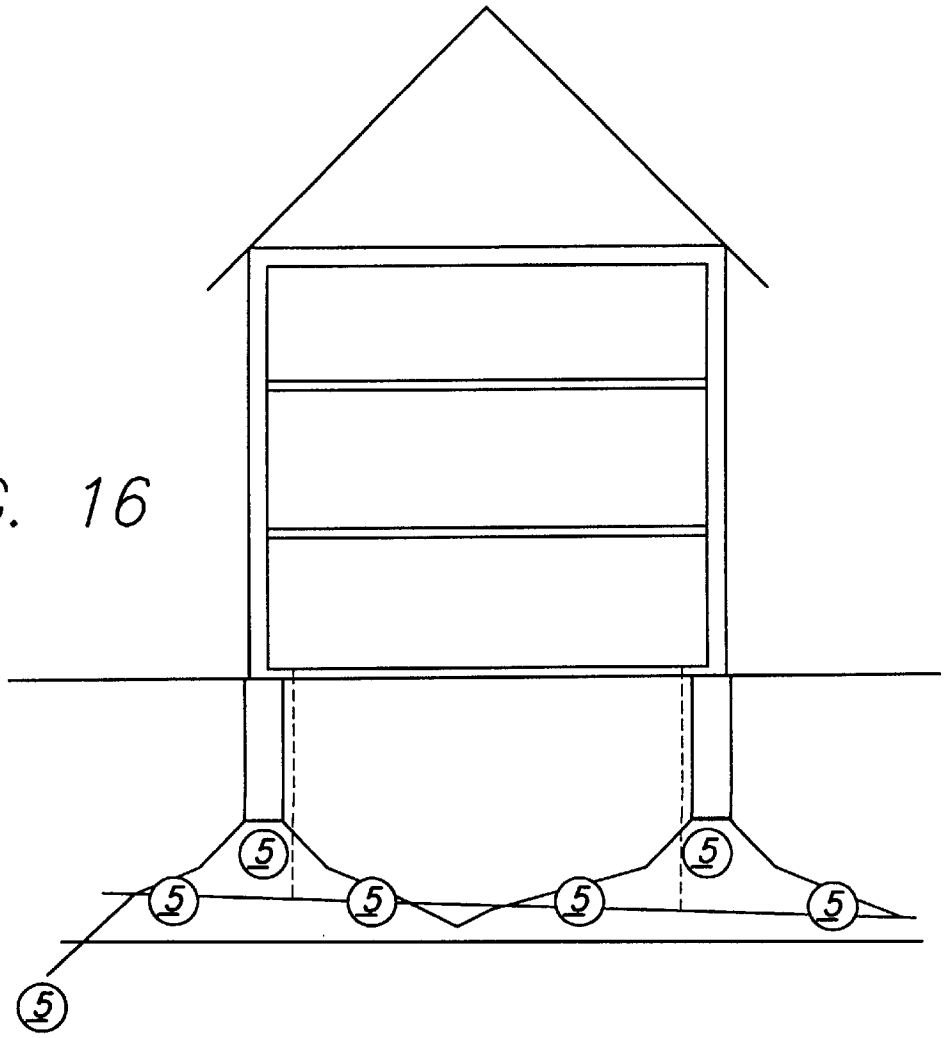
FIG. 16 is a sectional view of a building to be underpinned, different subsoil layers, distribution of the load thereon following underpinning, and a level regulating anchor and a bore for direct lifting of buildings.

In accordance with the representation of FIG. 16 it is possible to drill through the margin of the propagation zone of the foundation load without any danger to buildings. It is advantageous to perform this in the vicinity of the layer which is prone to settling, whereby the surrounding ground area is also solidified upon subsequent injection of binding agent into the bore. As a result, the load propagation angle is reduced and the building rests more stably. For injecting in order to solidify the bores, which may furthermore be reinforced with perforated polyethylene (PE) pipes, different pressures (up to 200 bar are currently available) may be employed. For example in FIG. 13, the bore is plotted as an underpinning bore in a central position under the foundation 2. At corresponding pressures during injection, the foundation may even be lifted. This is achieved in a controlled manner by introducing vertical anchors which will admit the corresponding lift by slacking.

I claim:

1. A method for underpinning a building comprising the step of arranging at least one elongated supporting element underneath a foundation of said building, wherein said foundation extends horizontally beneath at least a portion of said building and wherein said at least one elongated supporting element is arranged substantially parallel to the foundation of said building with a space provided between said foundation and said at least one elongated supporting element.

2. The method according to claim 1, further comprising the step of arranging a plurality of elongated supporting elements underneath the foundation of said building wherein at least two of plurality of said elongated supporting elements are coupled to each other.

3. The method according to claim 2, further comprising the step of arranging said plurality of elongated supporting elements so as to form a grid.

4. The method according to claim 3, further comprising the step of arranging said plurality of elongated supporting elements so as to position at least one point of intersection of said grid underneath a vertical supporting structure of said building.

5. The method according to claim 4, further comprising the steps of forming a second bore in a downward orientation, arranging a support in said second bore, wherein said second bore is formed between the margin of said vertical supporting structure and said at least one elongated supporting element.

6. The method according to claim 5, further comprising the step of forming said support in said second bore by injecting concrete into said second bore.

7. The method according to claim 5, further comprising the steps of excavating an area between said at least one elongated supporting element and the foundation of said building, and filling said area with concrete.

8. The method according to claim 2, further comprising the step of arranging said plurality of elongated supporting elements in a stacked configuration.

9. The method according to claim 1, further comprising the step of forming said elongated supporting element by introducing a first bore underneath the foundation of said building, and by producing a concrete ring or concrete rod within said first bore.

10. The method according to claim 9, further comprising the step of creating said first bore by using an anchor boring device or a tunneling device.

11. The method according to claim 1, further comprising the step of forming a cavity in said at least one elongated supporting element and flooding said cavity with concrete.

12. The method according to claim 1, further comprising the step of lifting said building and correcting a structural imbalance of said building.

13. A method for forming a reinforced-concrete supporting element, comprising the steps of:

forming a bore underneath a foundation of a building, wherein said bore is formed by moving a boring apparatus from a starting area to a target area, wherein said bore is arranged substantially parallel to the foundation of said building and does not impact either said building or the foundation of said building, introducing at least one steel cable into said bore, and forming said reinforced-concrete supporting element inside said bore by combining said steel cable with a supporting element, wherein said starting area and said target area are located beyond the foundation of said building.

14. The method according to claim 13, further comprising the steps of retracting said boring apparatus into the starting area and pulling said at least one steel cable and said supporting element through said bore, wherein said at least one steel cable and said supporting element is pulled through said bore using a hauling element.

15. The method according to claim 13, further comprising the step of fastening said at least one steel cable to said supporting element, and pulling said at least one steel cable and said supporting element to said target area, wherein said at least one steel cable and said supporting element are pulled through said bore using a cable winch located in said target area.

16. The method according to claim 13, further comprising the step of pulling said at least one steel cable and said supporting element to said starting area through said bore, wherein said at least one steel cable and said supporting element are pulled by said boring apparatus.

17. The method according to claim 13, further comprising the step of combining said at least one steel cable with said supporting element so as to form a spiral.

18. The method according to claim 13, further comprising the step of providing said at least one steel cable in the form of a coil and unwinding said coil as said at least one steel cable is being introduced into said bore.

19. The method according to claim 13, further comprising the steps of:

introducing a concrete delivery hose into said bore, pulling said hose along with said at least one steel cable and said supporting element, and filling said bore with concrete through said hose.

20. A method for underpinning a building having a foundation that extends horizontally beneath at least a portion of said building, the method comprising the steps of:

arranging at least one elongated supporting element in a section of ground underneath said foundation and substantially parallel to said foundation, and wherein said arranging step further comprises providing a space between said at least one elongated supporting element and both said foundation and said building, said at least one elongated supporting element thereby reinforcing the section of ground underneath said foundation.

21. The method according to claim 20, further comprising the step of arranging a plurality of elongated supporting elements underneath the foundation of said building wherein at least two of plurality of said elongated supporting elements are coupled to each other.

22. The method according to claim 21, further comprising the step of arranging said plurality of elongated supporting elements so as to form a grid.

23. The method according to claim 22, further comprising the step of arranging said plurality of elongated supporting elements so as to position at least one point of intersection of said grid underneath a vertical supporting structure of said building.

24. The method according to claim 23, further comprising the steps of forming a second bore in a downward orientation, arranging a support in said second bore, wherein said second bore is formed between the margin of said vertical supporting structure and said at least one elongated supporting element.

25. The method according to claim 24, further comprising the step of forming said support in said second bore by injecting concrete into said second bore.

26. The method according to claim 24, further comprising the steps of excavating an area between said at least one elongated supporting element and the foundation of said building, and filling said area with concrete.

27. The method according to claim 21, further comprising the step of arranging said plurality of elongated supporting elements in a stacked configuration.

28. The method according to claim 20, further comprising the step of forming said elongated supporting element by introducing a first bore underneath the foundation of said building, and by producing a concrete ring or concrete rod within said first bore.

29. The method according to claim 28, further comprising the step of creating said first bore by using an anchor boring device or a tunneling device.

30. The method according to claim 20, further comprising the step of forming a cavity in said at least one elongated supporting element and flooding said cavity with concrete.

* * * * *